US012414601B2

(12) United States Patent
Cheney et al.

(10) Patent No.: US 12,414,601 B2
(45) **Date of Patent: *Sep. 16, 2025**

(54) RAPID-ENTRY FOOTWEAR HAVING A TRANSFORMING FOOTBED

(71) Applicant: FAST IP, LLC, Lindon, UT (US)

(72) Inventors: Craig Cheney, Lindon, UT (US); Seth Munger, Springville, UT (US); Bradley Johnson, Draper, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/407,199

(22) Filed: Jan. 8, 2024

(65) Prior Publication Data

US 2024/0138516 A1 May 2, 2024

Related U.S. Application Data

(63) Continuation of application No. 17/827,954, filed on May 30, 2022, now Pat. No. 11,864,620, which is a continuation of application No. PCT/US2022/016867, filed on Feb. 17, 2022.

(60) Provisional application No. 63/150,550, filed on Feb. 17, 2021.

(51) Int. Cl.

| | |
|---|---|
| ***A43B 11/00*** | (2006.01) |
| ***A43B 3/26*** | (2006.01) |
| ***A43B 23/08*** | (2006.01) |

(52) U.S. Cl.

CPC ..... *A43B 11/00* (2013.01); *A43B 3/26* (2013.01); *A43B 23/08* (2013.01); *A43B 23/088* (2013.01)

(58) Field of Classification Search

CPC ..... A43B 11/00; A43B 11/02; A43B 17/18; A43B 23/08; A43B 23/088; A43B 23/28

USPC ..... 36/138

See application file for complete search history.

(56) References Cited

U.S. PATENT DOCUMENTS

| | | | |
|---|---|---|---|
| 112,439 | A | 3/1871 | Francis |
| 287,312 | A | 10/1883 | Packard |
| 736,156 | A | 8/1903 | Roberts |
| 808,948 | A | 1/1906 | Roberts |
| 827,330 | A | 7/1906 | Tillson |
| 863,549 | A | 8/1907 | Metz |
| 881,153 | A | 3/1908 | Rickert |
| 921,461 | A | 5/1909 | Rickert |
| 923,860 | A | 6/1909 | Kroell |
| 1,081,678 | A | 12/1913 | Meyer |
| 1,116,462 | A | 11/1914 | Moran |
| 1,266,620 | A | 5/1918 | Peabody |

(Continued)

FOREIGN PATENT DOCUMENTS

| | | | |
|---|---|---|---|
| CN | 1403041 | A | 3/2003 |
| CN | 201005111 | Y | 1/2008 |

(Continued)

OTHER PUBLICATIONS https://us.ecco.com/ecco-biom-fjuel-mens-outdoor-shoe-837594.html?dwvar_837594_color=00001 submitted herewith as of Jun. 1, 2016.

(Continued)

*Primary Examiner* — Marie D Bays

(57) ABSTRACT

A rapid-entry shoe with a sole portion and a footbed that slide, pivot or translate relative to each other to provide both an open configuration (for ease of donning or doffing by a foot) and a closed configuration (for securement of a foot).

20 Claims, 11 Drawing Sheets

(56) References Cited

U.S. PATENT DOCUMENTS 1,464,342 A 8/1923 Rothacher
1,494,236 A 5/1924 Greathouse
1,686,175 A 10/1928 Read
1,926,818 A 9/1933 Rateliff
2,069,752 A 2/1937 Dorr
2,083,390 A 6/1937 Murena
2,118,019 A 5/1938 Benjafield
2,266,732 A 12/1941 Babinchak
2,297,594 A 9/1942 Weinstat
2,368,514 A 1/1945 Baehr
2,450,250 A 9/1948 Napton
2,452,502 A 10/1948 Tarbox
2,693,039 A 11/1954 Balut
2,736,110 A 2/1956 Hardimon
2,763,071 A 9/1956 Napier
2,829,448 A 4/1958 Minera
2,920,402 A 1/1960 Minera
3,000,116 A 9/1961 Ally
3,014,288 A 12/1961 Evans et al.
3,040,454 A 6/1962 Topper et al.
3,097,438 A 7/1963 Evans
3,146,535 A 9/1964 Owings
3,192,651 A 7/1965 Smith
3,373,512 A 3/1968 Jacobson
3,643,350 A 2/1972 Paoletta et al.
3,798,802 A 3/1974 Saunders
4,489,509 A 12/1984 Libit
4,590,690 A 5/1986 Pfander
4,596,080 A 6/1986 Benoit et al.
4,805,321 A 2/1989 Tonkel
4,811,502 A 3/1989 Barret
4,924,605 A 5/1990 Spademan
4,972,613 A 11/1990 Loveder
4,979,319 A 12/1990 Hayes
5,054,216 A 10/1991 Lin
5,090,140 A 2/1992 Sessa
5,127,170 A 7/1992 Messina
5,174,050 A 12/1992 Gabrielli
5,181,331 A 1/1993 Berger
5,184,410 A 2/1993 Hamilton
5,257,470 A 11/1993 Auger et al.
5,259,126 A 11/1993 Rosen
5,265,353 A 11/1993 Marega et al.
5,282,327 A 2/1994 Ogle
5,311,678 A 5/1994 Spademan
5,341,583 A 8/1994 Hallenbeck
5,351,583 A 10/1994 Szymber et al.
5,353,526 A 10/1994 Foley et al.
5,371,957 A 12/1994 Gaudio
5,430,961 A 7/1995 Faulconer et al.
5,467,537 A 11/1995 Aveni et al.
5,481,814 A 1/1996 Spencer
5,806,208 A 9/1998 French
5,842,292 A 12/1998 Siesel
5,846,063 A 12/1998 Lakic
5,983,530 A 11/1999 Chou
5,997,027 A 12/1999 Jungkind
6,000,148 A 12/1999 Cretinon
6,014,823 A 1/2000 Lakic
6,125,555 A 10/2000 Schenkel
6,128,837 A 10/2000 Huang
6,170,173 B1 1/2001 Caston
6,189,239 B1 2/2001 Gasparovic et al.
6,290,559 B1 9/2001 Scott
6,321,466 B1 11/2001 Bordin et al.
6,360,454 B1 3/2002 Dachgruber et al.
6,367,171 B1 4/2002 Burt
6,378,230 B1 4/2002 Rotem et al.
6,427,361 B1 8/2002 Chou
6,470,537 B1 10/2002 Schallenkamp
6,643,954 B2 11/2003 Voswinkel
6,671,980 B1 1/2004 Liu
6,684,533 B1 2/2004 Su
6,839,985 B2 1/2005 Bettiol
6,877,252 B2 4/2005 Wilkinson
6,922,917 B2 8/2005 Kerns et al.
6,925,732 B1 8/2005 Clarke
7,059,068 B2 6/2006 Magallanes et al.
7,103,994 B2 9/2006 Johnson
7,178,270 B2 2/2007 Hurd et al.
7,225,563 B2 6/2007 Chen et al.
7,439,837 B2 10/2008 McDonald
D583,956 S 12/2008 Chang et al.
7,661,205 B2 2/2010 Johnson
7,685,747 B1 3/2010 Gasparovic et al.
7,757,414 B2 7/2010 Tonkel
7,793,438 B1 9/2010 Busse et al.
7,823,299 B1 11/2010 Brigham
D648,512 S 11/2011 Schlageter et al.
8,087,188 B2 1/2012 Labbe
8,225,535 B2 7/2012 Dillenbeck
8,302,329 B2 11/2012 Hurd et al.
8,333,021 B2 12/2012 Johnson
8,499,474 B2 8/2013 Kaufman
8,745,901 B2 6/2014 Toraya
9,119,441 B2 9/2015 Frappier
9,314,067 B2 4/2016 Bock
9,351,532 B2 5/2016 Mokos
9,615,624 B2 4/2017 Kilgore et al.
9,629,416 B2 4/2017 Rackiewicz et al.
9,635,905 B2 5/2017 Dekovic
9,717,304 B2 8/2017 Bernhard et al.
9,877,542 B2 1/2018 Pratt
9,999,278 B2 6/2018 Feinstein
10,271,616 B2 4/2019 Labbe
10,327,515 B2 6/2019 Peyton et al.
D854,303 S 7/2019 Flanagan et al.
10,455,898 B1 10/2019 Orand et al.
10,499,707 B2 12/2019 Hobson et al.
10,506,842 B2 12/2019 Pratt et al.
10,537,154 B2 1/2020 Smith et al.
10,555,578 B2 2/2020 Pratt
10,568,382 B2 2/2020 Hatfield et al.
10,568,385 B2 2/2020 Beers et al.
10,602,802 B2 3/2020 Hopkins et al.
10,609,981 B1 4/2020 Phinney
10,617,174 B1 4/2020 Hopkins et al.
10,638,810 B1 5/2020 Cheney et al.
10,653,209 B2 5/2020 Pratt et al.
10,660,401 B1 5/2020 Pratt et al.
10,743,616 B2 8/2020 Beers et al.
10,791,796 B1 10/2020 Baker
10,813,405 B2 10/2020 Pratt
10,897,956 B2 1/2021 Hopkins
10,905,192 B1 2/2021 Cheney
10,912,348 B2 2/2021 Owings et al.
10,973,278 B2 4/2021 Raia
10,973,279 B2 4/2021 Cheney et al.
11,000,091 B1 5/2021 Kyle
11,064,761 B2 7/2021 Cheney
11,140,941 B2 10/2021 Xanthos et al.
11,154,113 B2 10/2021 Hatfield et al.
11,172,727 B2 11/2021 Hatfield et al.
11,191,321 B2 12/2021 Kilgore et al.
11,213,098 B2 1/2022 Beers et al.
11,234,482 B2 2/2022 Roser
D948,190 S 4/2022 Jury
D948,191 S 4/2022 Holmes
D949,540 S 4/2022 Jury
D949,544 S 4/2022 Witherow
11,344,077 B2 5/2022 Hopkins et al.
D955,732 S 6/2022 Kelley
11,490,680 B2 11/2022 Cheney et al.
11,607,002 B2 3/2023 Cheney
11,622,598 B2 4/2023 Bar
11,633,005 B2 4/2023 Pratt et al.
11,633,006 B2 4/2023 Pratt et al.
11,633,016 B2 4/2023 Orand et al.
11,659,886 B2 5/2023 Cheney et al.
11,700,916 B2 7/2023 Kilgore et al.
11,707,113 B2 7/2023 Hopkins et al.
D993,601 S 8/2023 Wang et al.
11,737,511 B2 8/2023 Cheney et al.
11,744,319 B2 9/2023 Farina

(56) References Cited

U.S. PATENT DOCUMENTS

| | | | | |
|---|---|---|---|---|
| 11,864,620 | B2 * | 1/2024 | Cheney | A43B 17/18 |
| 2001/0001350 | A1 | 5/2001 | Aguerre | |
| 2002/0053147 | A1 | 5/2002 | Borsoi et al. | |
| 2002/0066213 | A1 | 6/2002 | Wells | |
| 2002/0095823 | A1 | 7/2002 | Laio et al. | |
| 2002/0144434 | A1 | 10/2002 | Farys et al. | |
| 2002/0174568 | A1 | 11/2002 | Neiley | |
| 2003/0106244 | A1 | 6/2003 | Miller et al. | |
| 2004/0003517 | A1 | 1/2004 | Marvin et al. | |
| 2004/0088890 | A1 | 5/2004 | Matis et al. | |
| 2004/0111921 | A1 | 6/2004 | Lenormand | |
| 2005/0022428 | A1 | 2/2005 | Anderson | |
| 2005/0034328 | A1 | 2/2005 | Geer | |
| 2005/0039348 | A1 | 2/2005 | Raluy et al. | |
| 2005/0066543 | A1 | 3/2005 | Rosen et al. | |
| 2005/0076540 | A1 | 4/2005 | Su | |
| 2005/0198867 | A1 | 9/2005 | Labbe | |
| 2005/0241189 | A1 | 11/2005 | Elkington et al. | |
| 2006/0037215 | A1 | 2/2006 | Lee | |
| 2007/0074425 | A1 | 4/2007 | Leong | |
| 2007/0180730 | A1 | 8/2007 | Greene et al. | |
| 2007/0209234 | A1 | 9/2007 | Chou | |
| 2007/0256329 | A1 | 11/2007 | Antonelli et al. | |
| 2007/0271822 | A1 | 11/2007 | Meschter | |
| 2007/0277394 | A1 | 12/2007 | Hansen et al. | |
| 2008/0168683 | A1 | 7/2008 | Keating | |
| 2008/0189984 | A1 | 8/2008 | Januszewski et al. | |
| 2008/0276492 | A1 | 11/2008 | Burnett | |
| 2008/0307673 | A1 | 12/2008 | Johnson | |
| 2008/0313929 | A1 | 12/2008 | Hoyt | |
| 2009/0090026 | A1 | 4/2009 | Mosher | |
| 2009/0223084 | A1 | 9/2009 | Kaufman | |
| 2010/0037483 | A1 | 2/2010 | Meschter et al. | |
| 2010/0095494 | A1 | 4/2010 | Martin | |
| 2010/0095554 | A1 | 4/2010 | Gillespie | |
| 2010/0251572 | A1 | 10/2010 | Baudouin et al. | |
| 2011/0016751 | A1 | 1/2011 | Somerville | |
| 2011/0185592 | A1 | 8/2011 | Nishiwaki et al. | |
| 2011/0214313 | A1 | 9/2011 | James et al. | |
| 2011/0239489 | A1 | 10/2011 | Iuchi et al. | |
| 2011/0277350 | A1 | 11/2011 | Huynh | |
| 2012/0055044 | A1 | 3/2012 | Dojan et al. | |
| 2012/0060395 | A1 | 3/2012 | Blevens et al. | |
| 2012/0151799 | A1 | 6/2012 | Weinreb | |
| 2012/0167413 | A1 | 7/2012 | Marvin et al. | |
| 2012/0180338 | A1 | 7/2012 | Lin | |
| 2012/0216429 | A1 | 8/2012 | Bastida et al. | |
| 2013/0160328 | A1 | 6/2013 | Hatfield et al. | |
| 2013/0185959 | A1 | 7/2013 | Coleman | |
| 2013/0219747 | A1 | 8/2013 | Lederer | |
| 2013/0312285 | A1 | 11/2013 | Sharma et al. | |
| 2014/0013624 | A1 | 1/2014 | Stockbridge et al. | |
| 2014/0090274 | A1 | 4/2014 | Arquilla | |
| 2014/0101975 | A1 | 4/2014 | Ueda | |
| 2014/0123516 | A1 | 5/2014 | Cressman et al. | |
| 2014/0173932 | A1 | 6/2014 | Bell | |
| 2014/0189964 | A1 | 7/2014 | Wen et al. | |
| 2014/0202044 | A1 | 7/2014 | Adami et al. | |
| 2014/0259781 | A1 | 9/2014 | Sakai | |
| 2014/0298687 | A1 | 10/2014 | Flinterman et al. | |
| 2014/0305005 | A1 | 10/2014 | Yeh | |
| 2014/0373396 | A1 | 12/2014 | Chang | |
| 2015/0013184 | A1 | 1/2015 | Beers | |
| 2015/0013189 | A1 | 1/2015 | Hanak et al. | |
| 2015/0020416 | A1 | 1/2015 | Wiens | |
| 2015/0047222 | A1 | 2/2015 | Rushbrook | |
| 2015/0047223 | A1 | 2/2015 | Flinterman et al. | |
| 2015/0165338 | A1 | 6/2015 | Choe | |
| 2015/0216252 | A1 | 8/2015 | Wiens | |
| 2015/0305432 | A1 | 10/2015 | Wiens | |
| 2015/0305442 | A1 | 10/2015 | Ravindran | |
| 2016/0007674 | A1 | 1/2016 | Labonte et al. | |
| 2016/0128424 | A1 | 5/2016 | Connell et al. | |
| 2016/0128429 | A1 | 5/2016 | Hatfield et al. | |
| 2016/0262492 | A1 | 9/2016 | Fujita et al. | |
| 2016/0302530 | A1 | 10/2016 | Smith et al. | |
| 2016/0374427 | A1 | 12/2016 | Zahabian | |
| 2017/0013915 | A1 | 1/2017 | Caston, Jr. | |
| 2017/0035148 | A1 | 2/2017 | Marvin et al. | |
| 2017/0055630 | A1 | 3/2017 | Marshall | |
| 2017/0127755 | A1 | 5/2017 | Bunnell et al. | |
| 2017/0265562 | A1 | 9/2017 | Mullen | |
| 2017/0303632 | A1 | 10/2017 | Pratt et al. | |
| 2017/0360141 | A1 | 12/2017 | Azoulay et al. | |
| 2017/0360143 | A1 | 12/2017 | Pratt et al. | |
| 2018/0110287 | A1 * | 4/2018 | Hopkins | A43C 1/00 |
| 2018/0199659 | A1 | 7/2018 | Lintaman | |
| 2018/0235314 | A1 | 8/2018 | Farage | |
| 2018/0255865 | A1 | 9/2018 | Hsu | |
| 2018/0263332 | A1 | 9/2018 | Bruno | |
| 2018/0295942 | A1 | 10/2018 | Drake | |
| 2018/0338572 | A1 | 11/2018 | Cross et al. | |
| 2018/0343968 | A1 | 12/2018 | James et al. | |
| 2019/0053571 | A1 | 2/2019 | Bjornson et al. | |
| 2019/0116916 | A1 | 4/2019 | Burch | |
| 2019/0281920 | A1 | 9/2019 | Ito et al. | |
| 2019/0289960 | A1 | 9/2019 | Loveder | |
| 2019/0297999 | A1 | 10/2019 | Nakaya et al. | |
| 2019/0307208 | A1 | 10/2019 | Corcoran-Tadd et al. | |
| 2019/0365029 | A1 | 12/2019 | Cross et al. | |
| 2019/0366667 | A1 | 12/2019 | Cross et al. | |
| 2020/0015544 | A1 | 1/2020 | Pratt | |
| 2020/0037703 | A1 | 2/2020 | Twist | |
| 2020/0046066 | A1 | 2/2020 | Difrancisco | |
| 2020/0068991 | A1 | 3/2020 | Steere et al. | |
| 2020/0085136 | A1 | 3/2020 | Pratt et al. | |
| 2020/0113274 | A1 | 4/2020 | Butler | |
| 2020/0187590 | A1 | 6/2020 | Hopkins et al. | |
| 2020/0196787 | A1 | 6/2020 | Dament et al. | |
| 2020/0205512 | A1 | 7/2020 | Blanche et al. | |
| 2020/0205516 | A1 | 7/2020 | Kilgore | |
| 2020/0205517 | A1 | 7/2020 | Happen | |
| 2020/0205518 | A1 | 7/2020 | Hopkins et al. | |
| 2020/0205520 | A1 | 7/2020 | Kilgore | |
| 2020/0245797 | A1 | 8/2020 | Kim | |
| 2020/0253333 | A1 | 8/2020 | Kilgore et al. | |
| 2020/0305552 | A1 | 10/2020 | Cheney et al. | |
| 2020/0323308 | A1 | 10/2020 | Dubuisson | |
| 2020/0375319 | A1 | 12/2020 | Yang | |
| 2020/0383424 | A1 | 12/2020 | Hughes | |
| 2021/0030107 | A1 | 2/2021 | Pratt et al. | |
| 2021/0059351 | A1 | 3/2021 | Piacentini | |
| 2021/0068493 | A1 | 3/2021 | Pratt et al. | |
| 2021/0068494 | A1 | 3/2021 | Zahabian | |
| 2021/0068498 | A1 | 3/2021 | Cheney et al. | |
| 2021/0106094 | A1 | 4/2021 | Cheney | |
| 2021/0112911 | A1 | 4/2021 | Pratt et al. | |
| 2021/0112914 | A1 | 4/2021 | Cheney | |
| 2021/0112916 | A1 | 4/2021 | Schulten | |
| 2021/0127788 | A1 | 5/2021 | Li | |
| 2021/0145114 | A1 | 5/2021 | Kyle | |
| 2021/0169177 | A1 | 6/2021 | Yang | |
| 2021/0186146 | A1 | 6/2021 | Erwin | |
| 2021/0204642 | A1 | 7/2021 | Kyle | |
| 2021/0204643 | A1 | 7/2021 | Kyle | |
| 2021/0204644 | A1 | 7/2021 | Kyle | |
| 2021/0204645 | A1 | 7/2021 | Pratt | |
| 2021/0227923 | A1 | 7/2021 | Love et al. | |
| 2021/0235811 | A1 | 8/2021 | Oh | |
| 2021/0282495 | A1 | 9/2021 | Davis et al. | |
| 2021/0321718 | A1 | 10/2021 | Chang | |
| 2021/0330033 | A1 | 10/2021 | Pratt et al. | |
| 2021/0337922 | A1 | 11/2021 | Cheney | |
| 2021/0345727 | A1 | 11/2021 | Raia | |
| 2021/0378356 | A1 | 12/2021 | Cheney et al. | |
| 2022/0053884 | A1 | 2/2022 | Kilgore et al. | |
| 2022/0104582 | A1 | 4/2022 | Christensen et al. | |
| 2022/0132976 | A1 | 5/2022 | Bentz | |
| 2022/0142291 | A1 | 5/2022 | Cheney et al. | |
| 2022/0240625 | A1 | 8/2022 | Shin | |
| 2022/0287406 | A1 | 9/2022 | Cheney et al. | |
| 2022/0287407 | A1 | 9/2022 | Cheney et al. | |
| 2022/0354220 | A1 | 11/2022 | Cheney | |
| 2022/0361627 | A1 | 11/2022 | Cheney et al. | |

(56) References Cited

U.S. PATENT DOCUMENTS

| | | | |
|---|---|---|---|
| 2022/0369758 | A1 | 11/2022 | Pratt |
| 2022/0378144 | A1 | 12/2022 | Pratt et al. |
| 2022/0400810 | A1 | 12/2022 | Cheney et al. |
| 2023/0030016 | A1 | 2/2023 | Pratt et al. |
| 2023/0030734 | A1 | 2/2023 | Farina |
| 2023/0033366 | A1 | 2/2023 | Farina |
| 2023/0035573 | A1 | 2/2023 | Bar |
| 2023/0052916 | A1 | 2/2023 | Bar |
| 2023/0055164 | A1 | 2/2023 | Cheney et al. |
| 2023/0077572 | A1 | 3/2023 | Dean et al. |
| 2023/0081272 | A1 | 3/2023 | Pratt |
| 2023/0084256 | A1 | 3/2023 | Brilliant |
| 2023/0218033 | A1 | 7/2023 | Cheney |
| 2023/0225450 | A1 | 7/2023 | Cheney et al. |
| 2023/0263270 | A1 | 8/2023 | Jones |
| 2023/0276897 | A1 | 9/2023 | Cheney et al. |
| 2023/0284737 | A1 | 9/2023 | Bar |

FOREIGN PATENT DOCUMENTS

| | | | |
|---|---|---|---|
| CN | 101991227 | A | 3/2011 |
| CN | 107467775 | A | 12/2017 |
| DE | 19534249 | A1 | 3/1997 |
| DE | 19611797 | A1 | 10/1997 |
| DE | 29809404 | U1 | 8/1998 |
| DE | 10247163 | A1 | 4/2004 |
| DE | 102004005288 | A1 | 8/2005 |
| EP | 1059044 | A1 | 12/2000 |
| EP | 1952715 | A1 | 8/2008 |
| EP | 3266327 | A1 | 1/2018 |
| FR | 3066679 | A1 | 11/2018 |
| GB | 2517399 | A | 2/2015 |
| JP | 01-081910 | U | 6/1989 |
| JP | 11-127907 | A | 5/1999 |
| JP | 2001-149394 | A | 6/2001 |
| JP | 2010-104416 | A | 5/2010 |
| JP | 2013-510685 | A | 3/2013 |
| JP | 2014-161721 | A | 9/2014 |
| KR | 10-2005-0095542 | A | 9/2005 |
| KR | 10-2009-0093548 | A | 9/2009 |
| KR | 10-2009-0130804 | A | 12/2009 |
| KR | 10-0936510 | B1 | 1/2010 |
| NL | 2000762 | C1 | 1/2009 |
| WO | 2007/080205 | A1 | 7/2007 |
| WO | 2009/089572 | A1 | 7/2009 |
| WO | 2009/154350 | A1 | 12/2009 |
| WO | 2017/004135 | A2 | 1/2017 |
| WO | 2018/230961 | A1 | 12/2018 |
| WO | 2019/215359 | A1 | 11/2019 |
| WO | 2020/006490 | A1 | 1/2020 |
| WO | 2020/176653 | A1 | 9/2020 |
| WO | 2021/162569 | A1 | 8/2021 |
| WO | 2022/221339 | A1 | 10/2022 |
| WO | 2023/064568 | A1 | 4/2023 |

OTHER PUBLICATIONS https://www.teva.com/kids-sandals/hurricane-drift/ 1102483C.html submitted herewith as of Jun. 13, 2019.

International Preliminary Report on Patentability received for PCT Patent Application No. PCT/US22/016867, mailed on Aug. 31, 2023, 8 pages.

International Search Report and Written Opinion received for PCT Patent Application No. PCT/US22/16867, mailed on May 13, 2022, 9 pages.

Sneider, "Kizik Handsfree New York Shoe Review," https://the-gadgeteer.com/2018/06/27/kizik-handsfree-new-york-show-review/ (2018).

U.S. Provisional Application filed Jun. 29, 2015 by Zahabian., U.S. Appl. No. 62/186,148.

* cited by examiner

RAPID-ENTRY FOOTWEAR HAVING A TRANSFORMING FOOTBED

CROSS-REFERENCE TO RELATED APPLICATIONS

This application is a continuation of, claims priority to and the benefit of U.S. Ser. No. 17/827,954 filed May 30, 2022 and entitled "RAPID-ENTRY FOOTWEAR HAVING A TRANSFORMING FOOTBED." U.S. Ser. No. 17/827,954 is a continuation of, claims priority to and the benefit of PCT Serial No. PCT/US22/16867 filed Feb. 17, 2022 and entitled "RAPID-ENTRY FOOTWEAR HAVING A TRANSFORMING FOOTBED." PCT Serial No. PCT/US22/16867 claims the benefit of U.S. Provisional Patent Application No. 63/150,550, filed Feb. 17, 2021 and entitled "RAPID-ENTRY FOOTWEAR HAVING A TRANSLATING FOOTBED." All of the aforementioned applications are incorporated herein by reference in their entireties.

FIELD

The present disclosure relates to footwear, and more particularly to rapid-entry footwear having a transforming footbed.

BACKGROUND

Whether due to inconvenience or inability, donning and doffing of shoes, including tying or otherwise securing the same, may be undesirable and/or present difficulties to some individuals. The present disclosure addresses this need.

SUMMARY

In example embodiments, a rapid-entry shoe of the present disclosure comprises a sole portion, a footbed and a separable upper. In accordance with an aspect of the present disclosure, the footbed is configured to transform (e.g., slide or pivot or translate or bow) with a first portion of the separable upper relative to the sole portion and a second portion of the separable upper between an open configuration having an expanded upper opening for ease of donning or doffing by a foot and a closed configuration having an unexpanded upper opening for securement of the foot. In accordance with an aspect of the present disclosure, in the closed configuration, the footbed is secured against the sole portion.

A rapid-entry shoe in accordance with the present disclosure comprises a sole portion, a footbed, and an upper. In accordance with example embodiments, the upper comprises an upper forward portion and an upper heel portion. In accordance with example embodiments, the sole portion is coupled to the upper heel portion.

In accordance with example embodiments, the footbed is coupled to the upper forward portion. In accordance with example embodiments, the footbed is configured to pivot relative to the sole portion between an open configuration, in which the footbed is angled relative to the sole portion, and a closed position, in which the footbed and the sole portion are substantially parallel to one another.

In accordance with example embodiments, the footbed is coupled to the upper forward portion to form a bootie. In accordance with example embodiments, the bootie is configured to pivot relative to the sole portion between an open configuration, in which a rear edge of the footbed is not in contact with a rear edge of the sole portion, and a closed position, in which the rear edge of the footbed is in contact with the rear edge of the sole portion.

In accordance with example embodiments, the bootie comprises a plurality of laces to secure a foot within the bootie.

In accordance with example embodiments, in the closed configuration, the rear edge of the footbed is positioned underneath at least one bumper coupled to an inner surface of the upper heel portion, the at least one bumper configured to secure the bootie in the closed position. In accordance with example embodiments, the at least one bumper is comprised of a foam material. In accordance with example embodiments, the at least one bumper comprises a dynamic bumper configured to be manually buckled such that, in the closed position, the rear edge of the footbed is no longer positioned underneath the at least one bumper, so as to no longer secure the bootie in the closed position.

In accordance with example embodiments, in the closed configuration, the rear edge of the footbed is positioned within an aperture of a dynamic hook, the aperture configured to secure the bootie in the closed position. In accordance with example embodiments, the dynamic hook comprises a living hinge configured to be manually opened such that, in the closed position, the rear edge of the footbed is no longer positioned within the aperture, so as to no longer secure the bootie in the closed position.

In accordance with example embodiments, the upper forward portion comprises a foot hold extending completely under the footbed between opposing sides of the footbed. In accordance with example embodiments, the foot hold comprises a plurality of laces.

In accordance with example embodiments, the upper forward portion is coupled to the sole portion exclusively at a forward portion of the sole portion.

BRIEF DESCRIPTION OF THE DRAWINGS

The accompanying drawings may provide a further understanding of example embodiments of the present disclosure and are incorporated in, and constitute a part of, this specification. In the accompanying drawings, only one rapid-entry shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
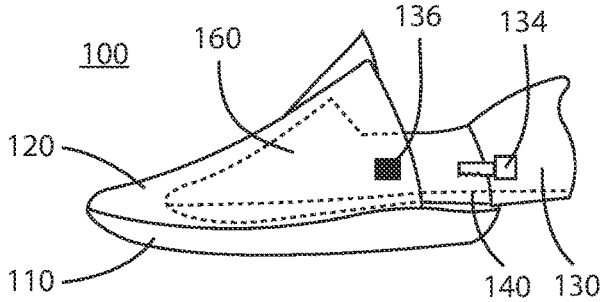
FIGS. 1A-1C illustrate footwear with a sliding footbed, in accordance with example embodiments of the present disclosure.
Figure 1B:
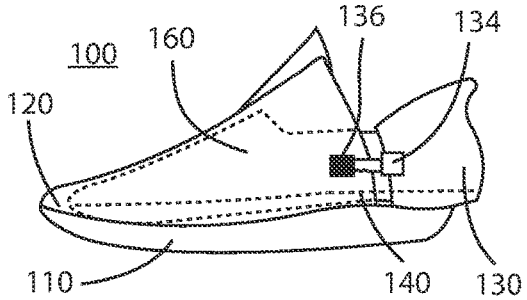
Figure 1C:
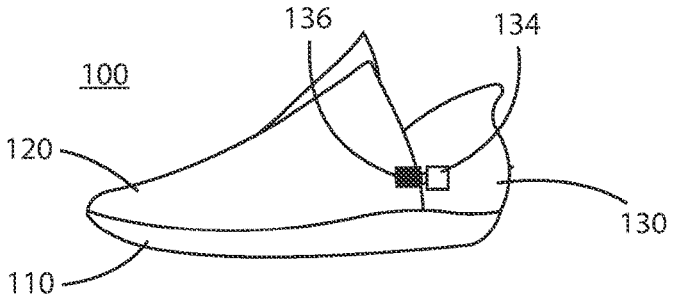

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the rapid-entry footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the rapid-entry footwear. These terms should be given meaning according to the manner in which the rapid-entry footwear is most typically designed for use, with the rapid-entry footwear on a user's foot and with the user's shod foot disposed on or ready for placement on an underlying surface. Thus, these directions may be understood relative to the rapid-entry footwear in such use. Similarly, as the rapid-entry footwear is intended primarily for use as footwear, terms such as "inner," "inward," "outer," "outward," "innermost," "outermost," "inside," "outside," and the like should be understood in reference to the rapid-entry footwear's intended use, such that inner, inward, innermost, inside, and the like signify relatively closer to the user's foot, and outer, outward, outermost, outside, and the like signify relatively farther from the user's foot when the rapid-entry footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, unless the context dictates otherwise, a "rapid-entry shoe" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a boot, or other suitable type of shoe. Additionally, a rapid-entry shoe can be sized and configured to be worn by men, women, or children.

As used herein, unless the context dictates otherwise, "footbed" can refer to an insole, sock liner, wedge or midsole, and "sole portion" can refer to a midsole or outsole.

As used herein, unless the context dictates otherwise, "upper heel portion" comprises a portion of the upper extending between medial and lateral sides, around the heel (e.g., heel counter and quarters), and "upper forward portion" can refer to comprises a portion of the upper extending between medial and lateral sides, over the forefoot (e.g., tongue, toe cap, vamp and quarters).

As used herein, unless the context dictates otherwise, "separable" refers to having at least two parts capable of relative movement, excluding a tongue in the case of a separable upper. As used herein, unless the context dictates otherwise, "slide" refers to relative 1-dimensional movement (e.g., along an axis parallel to the length of the footbed) while remaining substantially parallel. As used herein, unless the context dictates otherwise, "pivot" refers to relative movement resulting in an angle. As used herein, unless the context dictates otherwise, "translate" refers to relative 2-dimensional movement (e.g., along axes parallel and orthogonal to the length of the footbed) while remaining substantially parallel.

In example embodiments of the present disclosure, a footbed of a rapid-entry shoe is configured to move relative to a sole portion of a rapid-entry shoe, between an open configuration (for ease of donning or doffing by a foot) and a closed configuration (for securement of a foot). In example embodiments of the present disclosure, a foot applying a force (e.g., a downward and/or shear force) to the footbed moves it relative to the sole portion from an open configuration to a closed configuration. In connection with example embodiments, a sole portion of the rapid-entry shoe can be configured to remain substantially planar or otherwise not bend during the transition of a footbed of the rapid-entry shoe between the open and closed configurations.

In some embodiments, and with reference to FIGS. 1A-2D, an upper of a rapid-entry shoe 100 is a separable upper. In this regard, the upper can comprise an upper heel portion 130 and an upper forward portion 120. In example embodiments, an upper heel portion 130 of a rapid-entry shoe 100 is coupled to a footbed 140 and configured to slide, pivot or translate between an open configuration and a closed configuration relative to a sole portion 110 coupled to an upper forward portion 120. In connection with the foregoing embodiments, a bootie 160 can be coupled to the footbed 140. The bootie 160 can extend the length of the footbed (e.g., FIG. 1A) or can cover only a forward portion of the footbed and be open on the sides (e.g., FIG. 2A).

With reference now to FIGS. 1A-1E, in such embodiments, all or a portion of a footbed 140 can be configured to slide with an upper heel portion 130 rearward relative to a sole portion 110 and an upper forward portion 120. In such embodiments, the footbed 140 and the sole portion 110 can remain parallel or substantially parallel during the sliding. In such embodiments, sliding can be facilitated by corresponding male and female track components on the footbed 140 and the sole portion 110 or the upper forward portion 120. The upper heel portion 130 and the upper forward portion 120 can be secured to each another by a securement element (e.g., ratchet, strap) 136 comprising a securement release/tether 136.

Figure 1D:
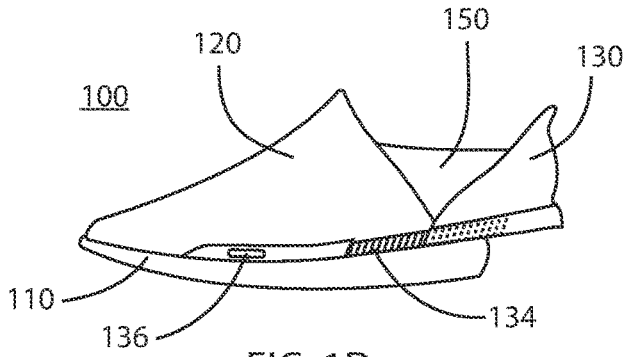
FIGS. 1D and 1E illustrate another embodiment of footwear with a sliding footbed, in accordance with the present disclosure.
Figure 1E:
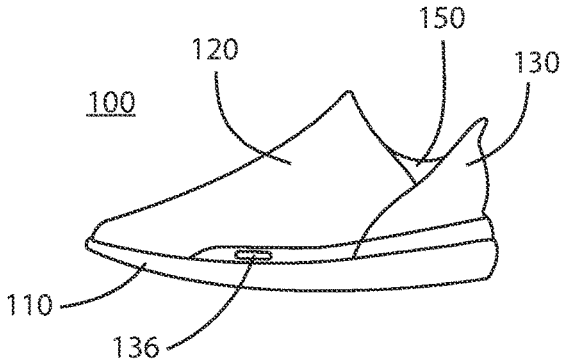
Figure 2A:
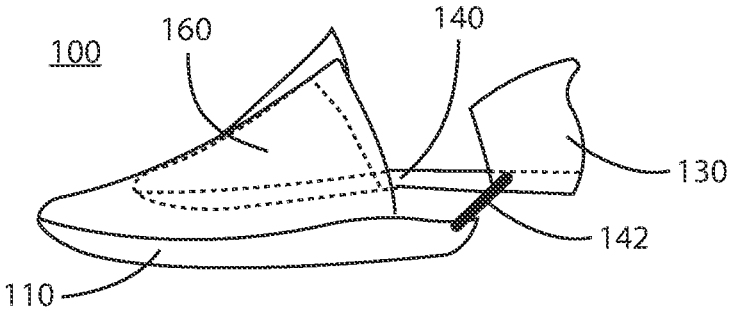
FIGS. 2A-2D illustrate footwear with a translating footbed and upper heel portion, in accordance with example embodiments of the present disclosure.
Figure 2B:
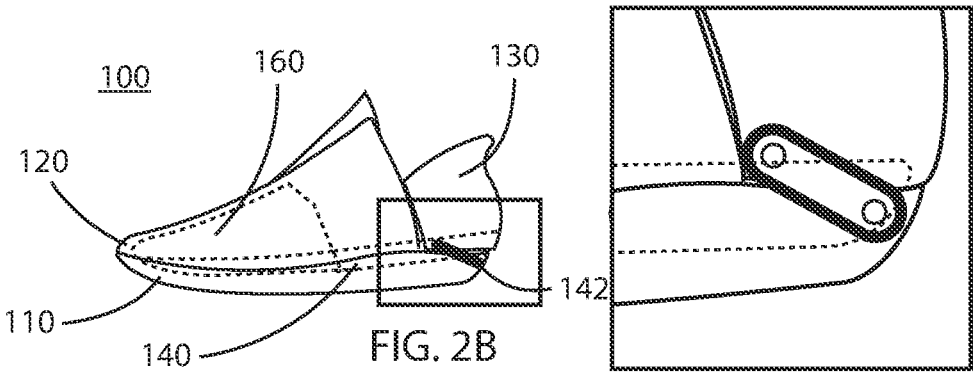
Figure 2C:
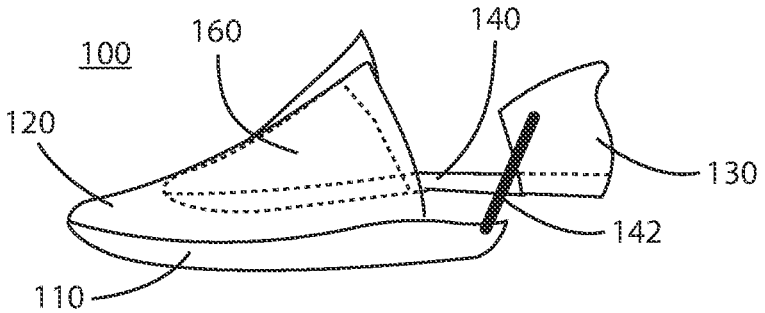
Figure 2D:
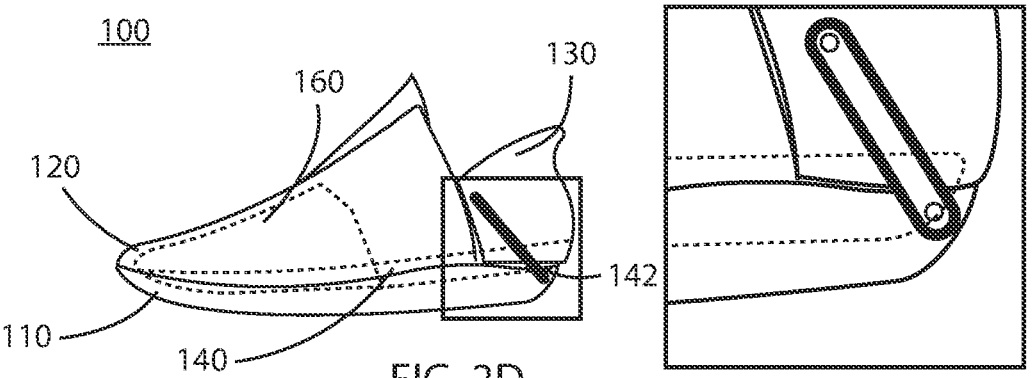

Paying particular attention to FIGS. 1D and 1E, an upper heel portion 130 and an upper forward portion 120 can be coupled to each other on one or both sides by a gore 150. The gore 150 may enhance weatherproofing of the rapid-entry shoe 100. The gore 150, in turn, can comprise a stretch material and/or a baffle material. In this regard, the upper heel portion 130 can be spring-loaded so as to be biased with the coupled footbed in the open configuration (e.g., FIG. 1D).

With reference to FIGS. 2A-2D, in such embodiments, all or a portion of a footbed 140 can be configured to translate with an upper heel portion 130 upward and rearward relative to a sole portion 110 and an upper forward portion 120. In such embodiments, the footbed 140 and the sole portion 110 can remain parallel or substantially parallel during the translation. In such embodiments, translation can be facilitated by a lever arm 142 extending at an angle between the sole portion 110 and a top (FIGS. 2C and 2D), middle, or bottom (FIGS. 2A and 2B) of the upper heel portion 130 (or between the sole portion 110 and the footbed 140), the lever arm 142 being configured to rotate (e.g., a circumferential, pin or ball bearing) relative to one or both of the footbed 140 and the sole portion 110.

A lever arm 142 can be on a single side of the rapid-entry shoe or on both sides of the rapid-entry shoe. A lever arm 142 can be coupled to the sole portion rearward relative to where the lever arm is coupled to the upper heel portion when in the closed configuration but forward relative to where the lever arm is coupled to the upper heel portion when in the open configuration. In such embodiments, the lever arm 142 can lock by going past center.

Rather than being coupled to a side of a sole portion 110 or footbed 140 as illustrated, a lever arm 142 can be coupled to an upper surface of the sole portion 110 and a lower surface of the footbed 140 and be received with a track within the sole portion 110 and/or the footbed 140. In such embodiments, a single lever arm 142 can be used (e.g., approximately equidistance between opposing sides of rapid entry-shoe 100) or a plurality of lever arms 142 can be used (e.g., 2, on opposing sides of rapid entry-shoe 100).

In other embodiments, and with reference to FIGS. 3A-5C, an upper of a rapid-entry shoe 100 is a separable upper. In this regard, the upper can comprise an upper heel portion 130 and an upper forward portion 120. In example embodiments, an upper forward portion 120 of a rapid-entry shoe 100 is coupled to a footbed 140 and configured to slide, pivot or translate between an open configuration and a closed configuration relative to a sole portion 110 coupled to an upper heel portion 130. In example embodiments, the upper forward portion 120 is not merely the tongue of the rapid-entry shoe, but instead, comprises the complete upper (excluding the upper heel portion 130). In this regard, the upper forward portion 120 can be coupled to the sole portion 110 exclusively at a forward portion of the sole portion (e.g., at or proximal to the site of the pin hinge 144 in FIGS. 3E and 3F). Stated another way, in example embodiments, the upper forward portion 120 is not coupled to the sole portion 110 at a rearward portion of the sole portion.

In example embodiments, a foot hold 170 can be coupled to the footbed 140. The foot hold 170 can comprise one or more of a strap (e.g., FIG. 3A), one or a plurality of laces (e.g., FIGS. 4A and 5A) and a bootie (e.g., FIGS. 3A, 4A, 5A). In example embodiments, the foot hold 170 terminates at and is coupled exclusively to opposing sides of the footbed 140, while in other embodiments, the foot hold 170 extends completely under the footbed 140 between opposing sides of the footbed 140. In example embodiments, unlike with conventional shoes, one or a plurality of laces are coupled to the upper and have vertices that are moveable relative to the sole portion.

With reference now to FIGS. 3A-4C, in such embodiments, all or a portion of a footbed 140 can be configured to pivot with an upper forward portion 120 upward relative to a sole portion 110 and an upper heel portion 130. In some embodiments, the sole portion 110 is configured to arc or bend during the pivoting. In other embodiments, the sole portion 110 is configured to remain substantially planar or otherwise not bend during the pivoting. In example embodiments, pivoting can be facilitated by a hinge (e.g., a living hinge or a pin hinge) between the footbed 140 and the sole portion 110. Pivoting can also be facilitated by the footbed 140 being resiliently deformable but stable in (e.g., biased toward) a non-planar or otherwise bent shape. In example embodiments, the footbed 140 can be secured into a rapid-entry shoe 100 against the sole portion 110 with a stationary bumper 112, discussed below.

Figure 3A:
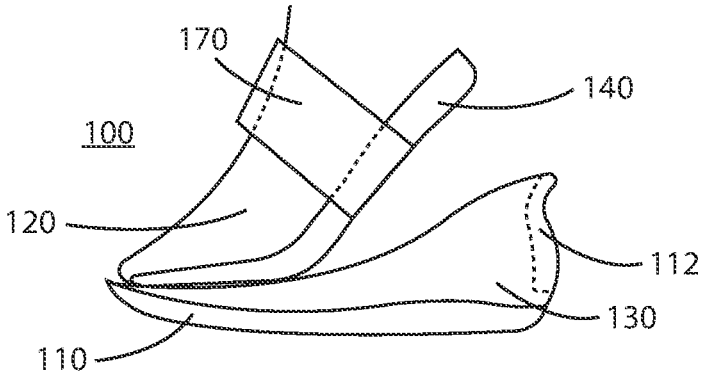
FIGS. 3A-3D illustrate footwear with a pivoting footbed, in accordance with example embodiments of the present disclosure.
Figure 3B:
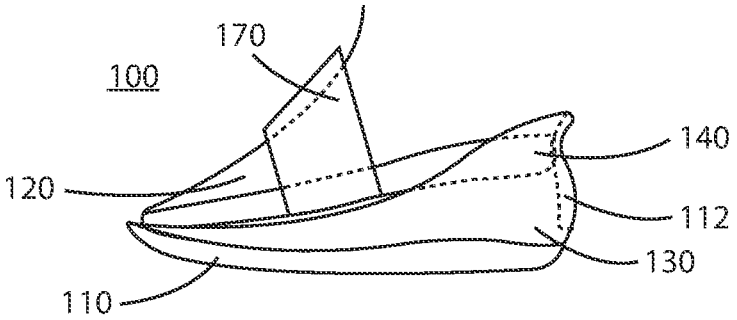
Figure 3C:
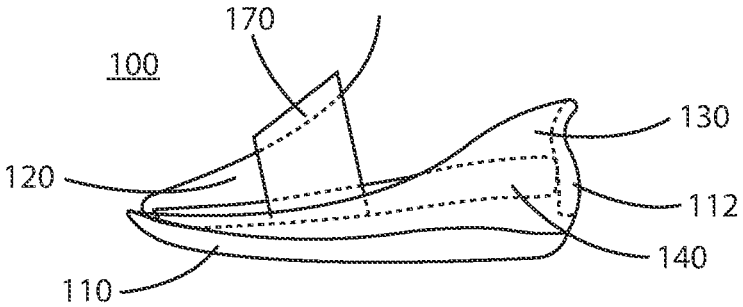
Figure 3D:
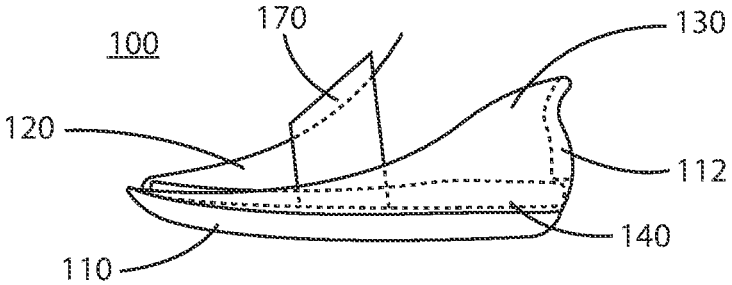
Figure 3E:
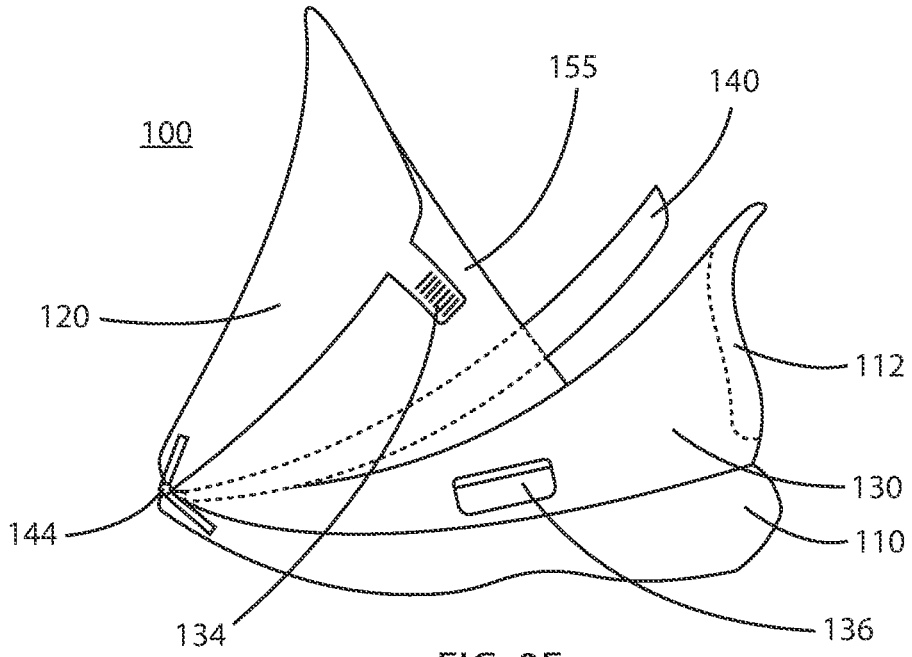
FIGS. 3E and 3F illustrate another embodiment of footwear with a pivoting footbed, in accordance with the present disclosure.
Figure 3F:
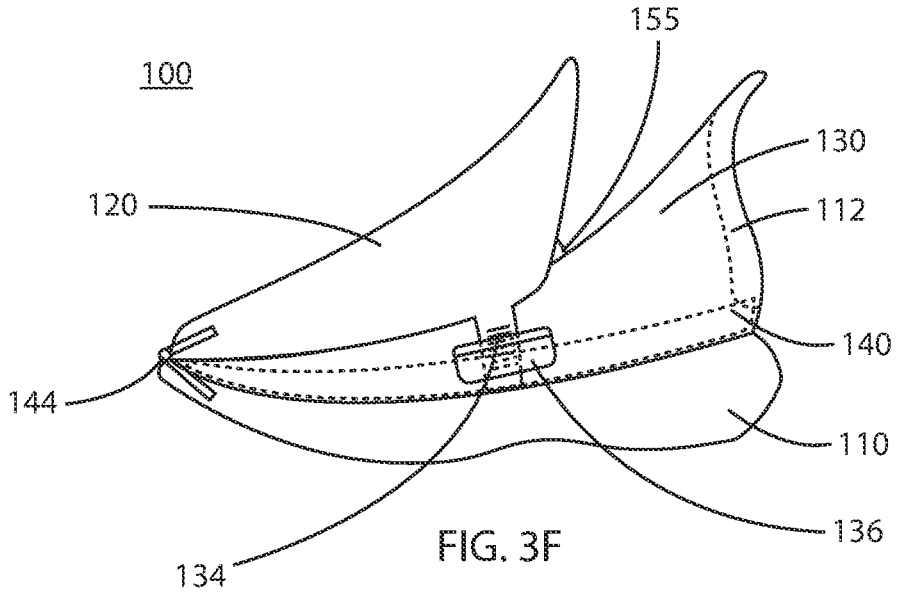

Paying particular attention to FIGS. 3E and 3F, an upper heel portion 130 and an upper forward portion 120 can be coupled to each other on one or both sides by a gusset 155. The gusset 155 may enhance weatherproofing of the rapid-entry shoe 100. The gusset 155, in turn, can comprise a stretch material and/or a baffle material. The upper heel portion 130 and the upper forward portion 120 can be secured to each another by a securement element (e.g., ratchet, strap) 136 comprising a securement release/tether 136.

With continued attention to FIGS. 3E and 3F, an upper heel portion 130 (and a sole portion 110) and an upper forward portion 120 (and a footbed 140) can be configured to pivot relative to each other via a pin hinge 144 (e.g., a spring-loaded pin hinge 144), a first side of the pin hinge 144 coupled to the upper heel portion 130 and a second side of the pin hinge 144 coupled to the upper forward portion 120.

Figure 4A:
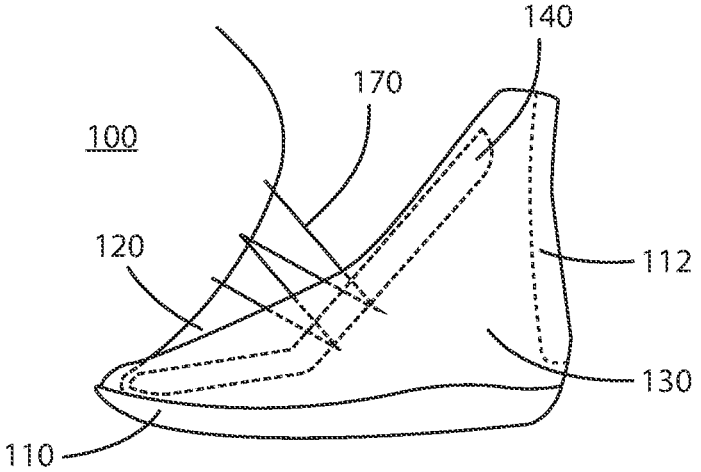
FIGS. 4A-4C illustrate footwear having the profile of a high-top shoe with a pivoting footbed, in accordance with example embodiments of the present disclosure.
Figure 4B:
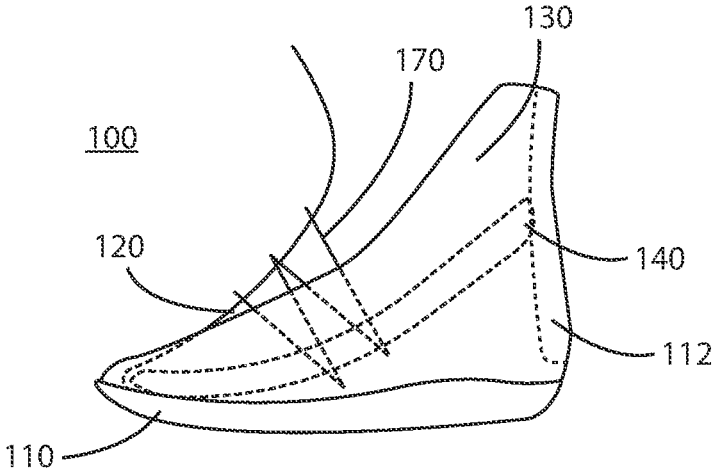
Figure 4C:
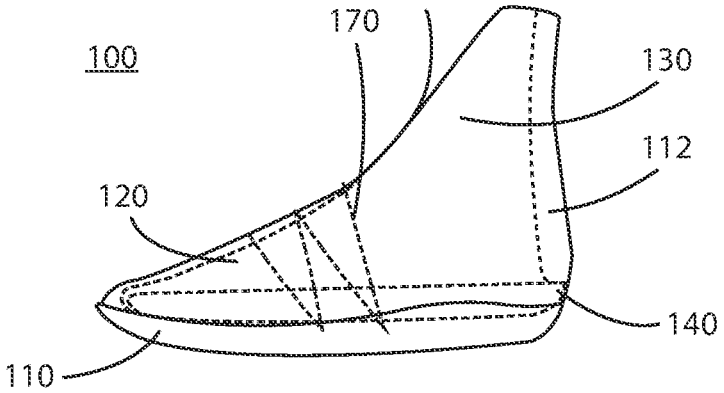

Turning now to FIGS. 4A-4C, a rapid-entry shoe 100 can comprise an upper heel portion 130 and an upper forward portion 120 both having the profile of a high-top shoe (e.g., a basketball shoe or a boot). In example embodiments, an additional strap or band may added over the top of the upper, coupled to and between opposing quarters, bluchers or upper panels, to secure the same together and/or secure the upper forward portion 120 and the footbed 140 relative to the sole portion 110 and the upper heel portion 130.

Figure 5A:
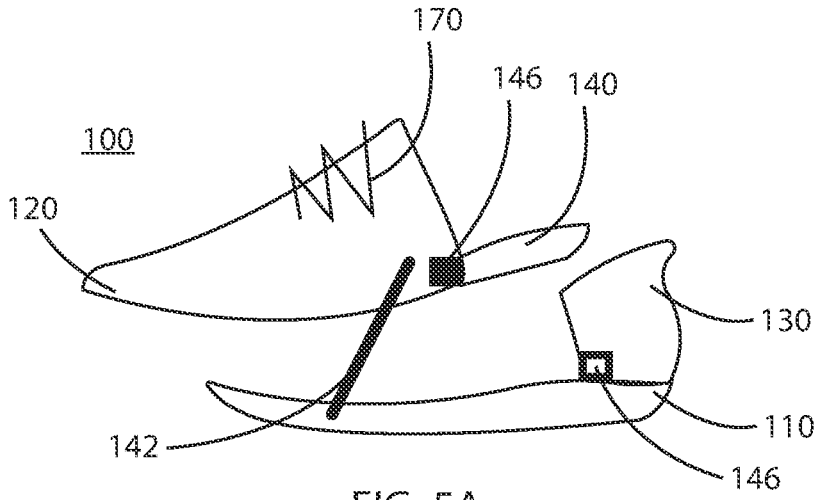
FIGS. 5A-5C illustrate footwear with a translating footbed and upper forward portion, in accordance with example embodiments of the present disclosure.
Figure 5B:
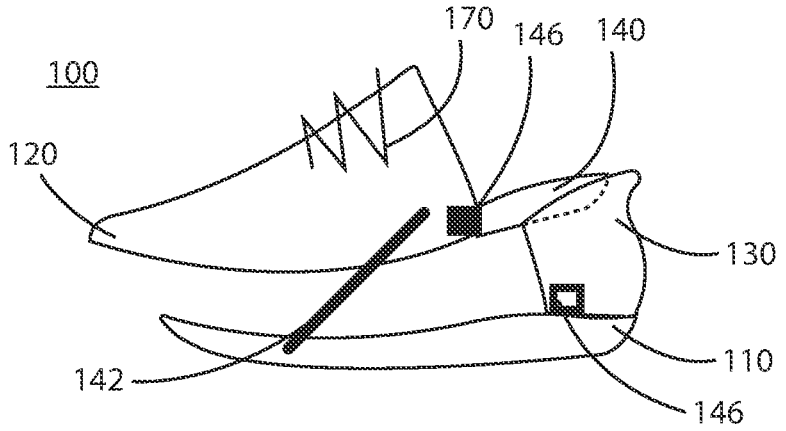
Figure 5C:
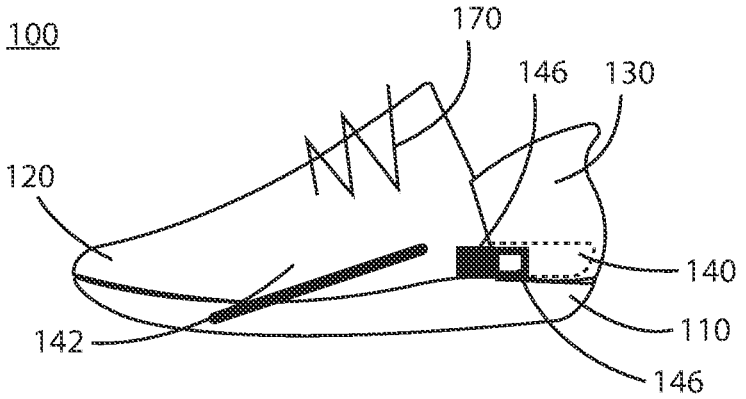

With reference to FIGS. 5A-5C, in such embodiments, all or a portion of a footbed 140 can be configured to translate with an upper forward portion 120 upward and forward relative to a sole portion 110 and an upper heel portion 130. In such embodiments, the footbed 140 and the sole portion 110 can remain parallel or substantially parallel during the translation. In such embodiments, translation can be facilitated by a lever arm 142 extending at an angle between the sole portion 110 and the upper forward portion 120 (or between the sole portion 110 and the footbed 140), the lever arm 142 being configured to rotate (e.g., a circumferential, pin or ball bearing) relative to one or both of the footbed 140 and the sole portion 110.

A lever arm 142 can be on a single side of the rapid-entry shoe or on both sides of the rapid-entry shoe. A lever arm 142 can be coupled to the sole portion forward relative to where the lever arm is coupled to the upper forward portion, when in both an open and a closed configuration.

Rather than being coupled to a side of a sole portion 110 or footbed 140 as illustrated, a lever arm 142 can be coupled to an upper surface of the sole portion 110 and a lower surface of the footbed 140 and be received with a track within the sole portion 110 and/or the footbed 140. In such embodiments, a single lever arm 142 can be used (e.g., approximately equidistance between opposing sides of rapid entry-shoe 100) or a plurality of lever arms 142 can be used (e.g., 2, on opposing sides of rapid entry-shoe 100).

In example embodiments, and with continued reference to FIGS. 5A-5C, a rapid-entry shoe 100 is secured in a closed configuration with one or more securement elements 146 comprising one or more of a hook and loop fastener, magnet, clip, tie, lever, ratchet or the like.

Alternatively, in accordance with any of the example embodiments described herein (e.g., FIGS. 3A-5C), when in the closed configuration, a footbed can be secured into a rapid-entry shoe against the sole portion with one or more of a stationary bumper, a dynamic bumper and a dynamic hook.

With reference to FIGS. 6A-6E, a rapid-entry shoe 100 can comprise a "bootie construction" that connects a tongue and a footbed 140 so they can move independently from the rest of the rapid-entry shoe 100. In such embodiments, a footbed 140 can be secured into a rapid-entry shoe 100 against the sole portion 110 with a stationary bumper 112 having a lip at its bottom (i.e., the stationary bumper 112 does not extend completely to the sole portion 110), the lip defining an aperture for receiving and securing an end of the footbed 140 underneath the lip. A foot applying a force (e.g., a downward and/or shear force) to the footbed 140 pushes an end of the footbed 140 past the lip and locks it under the lip, within the aperture. In this regard, an upper surface of the end of the footbed 140 be more rigid than a lower surface of the end of the footbed 140 to facilitate movement of the end of the footbed 140 past the lip and retention of it under the lip. Alternatively, a lower surface of the end of the footbed 140 can comprise a skid plate to facilitate movement of the end of the footbed 140 past the lip. In some embodiments, the footbed 140 can be compressible along an axis parallel to the length of the footbed.

Figure 6A:
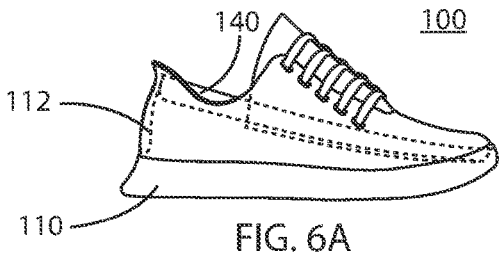
FIGS. 6A-6E illustrate a rapid-entry shoe having a stationary bumper to secure a footbed, in accordance with example embodiments of the present disclosure.
Figure 6B:
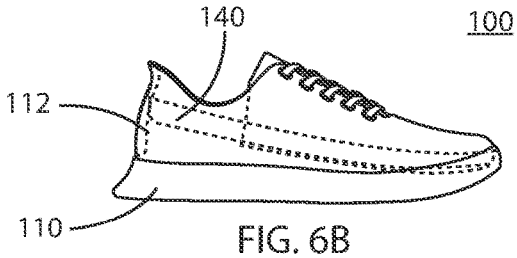
Figure 6C:
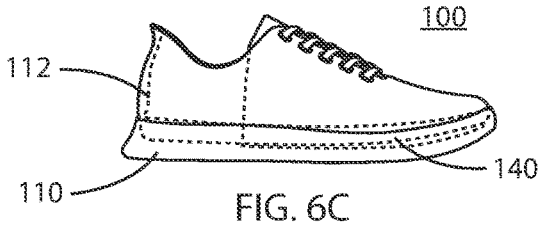
Figure 6D:
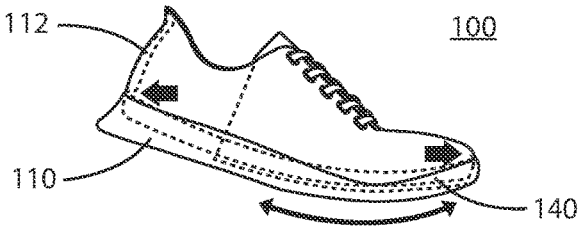
Figure 6E:
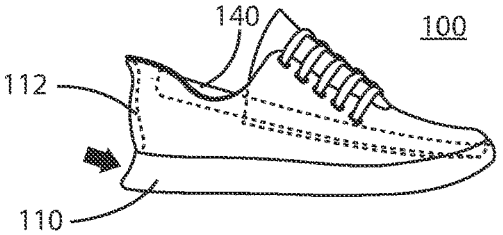
Figure 6F:
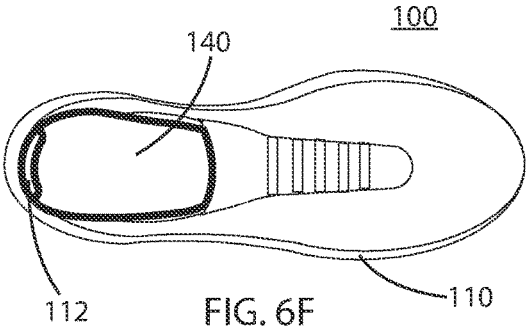
FIGS. 6F-6I illustrate rapid-entry shoes having different configurations of stationary bumpers, in accordance with example embodiments of the present disclosure.
Figure 6G:
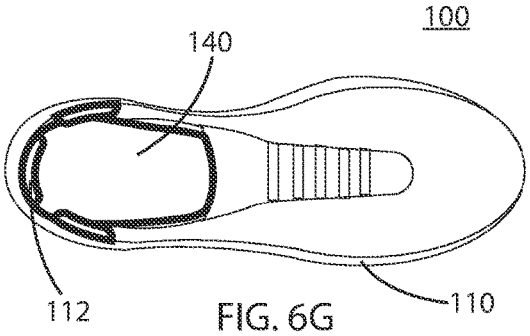
Figure 6H:
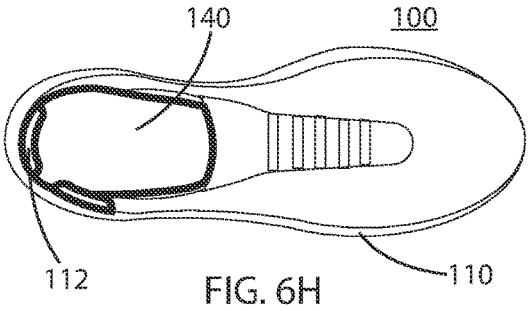

Additionally, with specific reference to FIG. 6D, articulation of the sole portion during motion results in the footbed 140 assuming an inverted arching shape that shears the footbed 140 rearward, pushing it tighter within the aperture and under the lip, locking the footbed 140 in tighter. In example embodiments, the stationary bumper 112 is configured to be manually buckled (e.g., with a toe of the other foot) such that, in the closed position, the rear edge or end of the footbed 140 is no longer positioned underneath the lip of the stationary bumper 112, so as to no longer secure the footbed 140 in the locked or closed position.

Figure 6I:
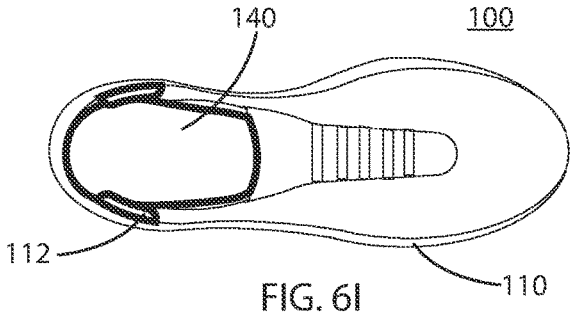

With reference to FIGS. 6F-6I, a footbed 140 can be secured into a rapid-entry shoe 100 against the sole portion 110 with a stationary bumper 112 at a rear of the upper heel portion (FIG. 6F), at a rear and opposing sides of the upper heel portion (FIG. 6G), at a rear and a single side of the upper heel portion (FIG. 6H) or at opposing sides of the upper heel portion (FIG. 6I). A stationary bumper 112 can be comprised of foam.

Figure 7A:
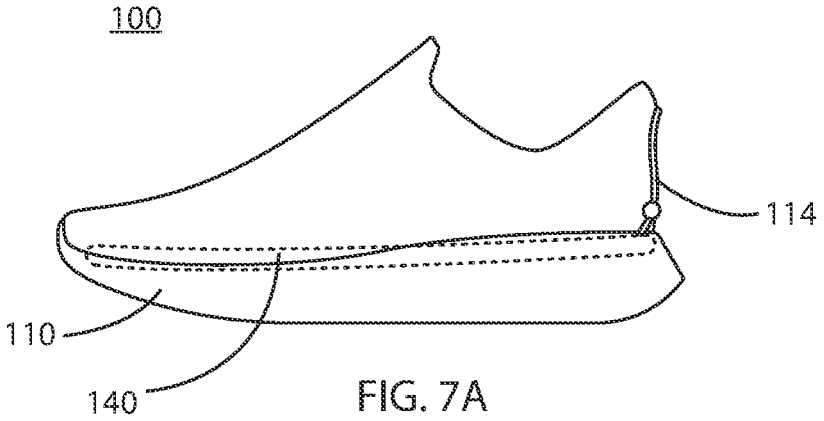
FIGS. 7A and 7B illustrate a rapid-entry shoe having a dynamic bumper to secure a footbed, in accordance with example embodiments of the present disclosure.
Figure 7B:
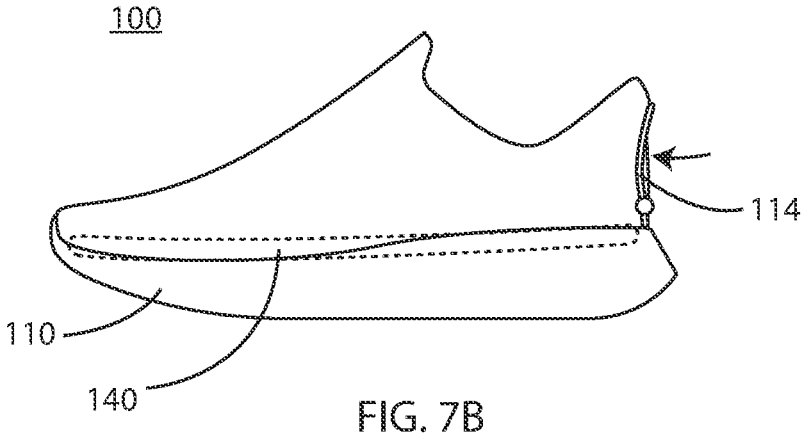

With reference to FIGS. 7A and 7B, a footbed 140 can be secured into a rapid-entry shoe 100 against the sole portion 110 with a dynamic bumper 114 having a lip at its bottom (i.e., the dynamic bumper 114 does not extend completely to the sole portion 110), the lip moveable from a position above an end of the footbed 140 (i.e., the footbed 140 locked down, FIG. 7A) to a position not above an end of the footbed 140 (i.e., the footbed 140 no longer locked down, FIG. 7B). In this regard, the dynamic bumper 114 can comprise a bistable elongated element or plate (e.g., bistable around an actuation point). In example embodiments, the dynamic bumper 114 is configured to be manually buckled (e.g., with a toe of the other foot) such that, in the closed position, the rear edge or end of the footbed 140 is no longer positioned underneath the lip of the dynamic bumper 114, so as to no longer secure the footbed 140 in the locked or closed position.

Figure 8A:
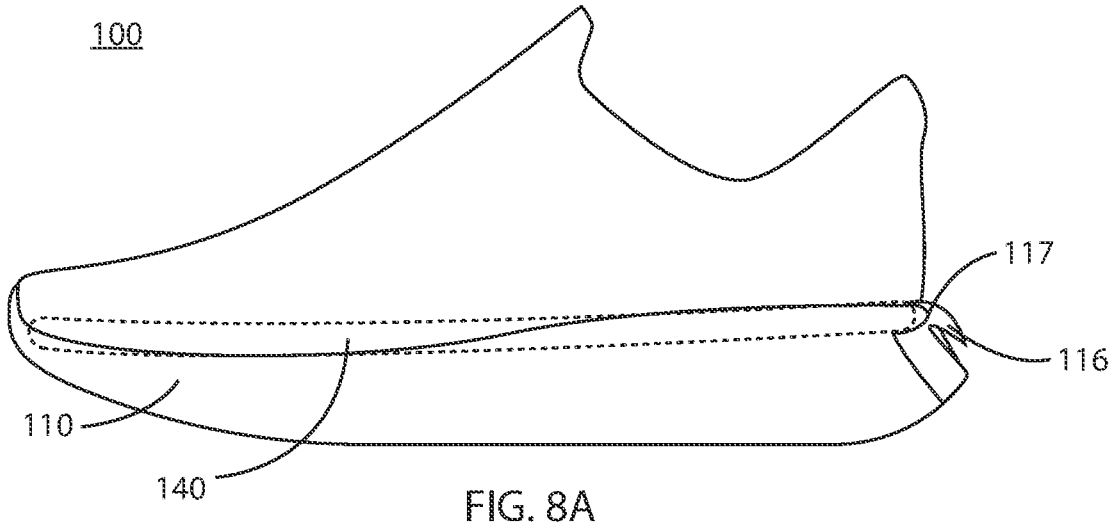
FIGS. 8A and 8B illustrate a rapid-entry shoe having a dynamic hook to secure a footbed, in accordance with example embodiments of the present disclosure.
Figure 8B:
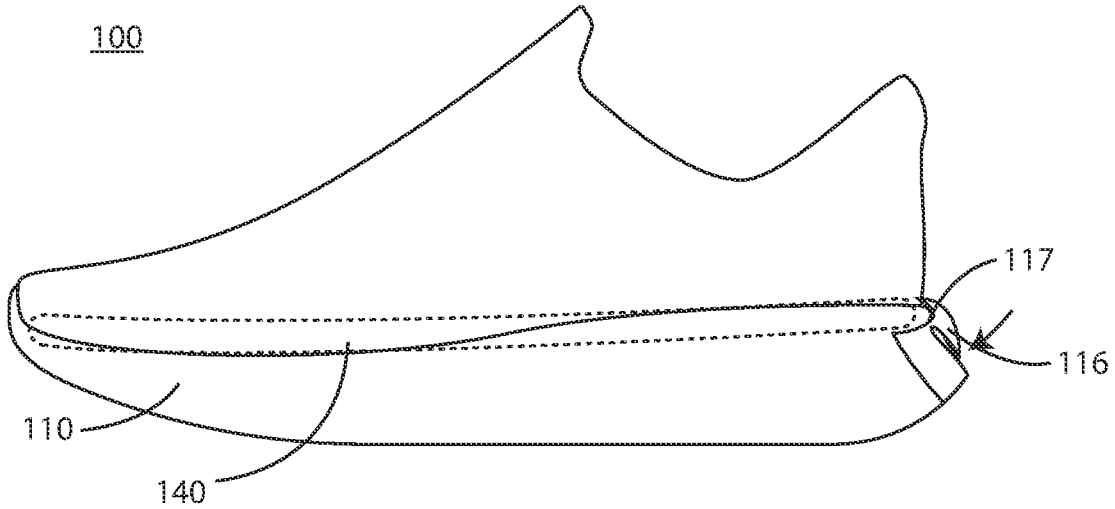

With reference to FIGS. 8A and 8B, a footbed 140 can be secured into a rapid-entry shoe 100 against the sole portion 110 with a dynamic hook 116, the dynamic hook 116 moveable from a position above an end of the footbed 140 (i.e., the footbed 140 locked down within an aperture 117, FIG. 8A) to a position not above an end of the footbed 140 (i.e., the footbed 140 no longer locked down within the aperture 117, FIG. 8B). In this regard, the dynamic hook 116 can comprise a living hinge. In example embodiments, the dynamic hook 116 is configured to be manually opened such that, in the closed position, the rear edge of the footbed 140 is no longer positioned within the aperture 117, so as to no longer secure the footbed 140 in the locked or closed position. The dynamic hook 116 can be formed in the foam of the midsole or comprise a TPU heel clip.

Figure 9A:
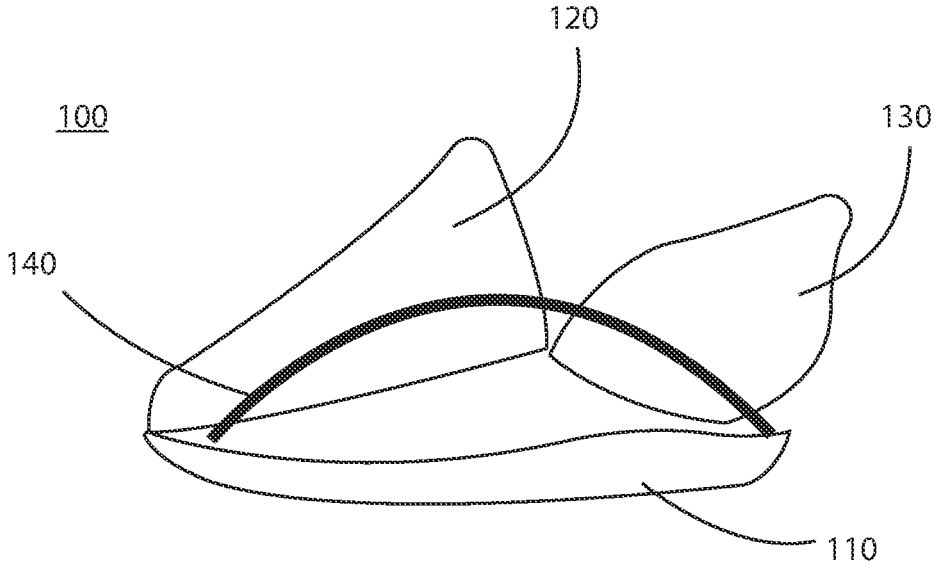
FIGS. 9A and 9B illustrate a rapid-entry shoe having a pivoting upper heel portion and a pivoting upper forward portion, in accordance with example embodiments of the present disclosure.
Figure 9B:
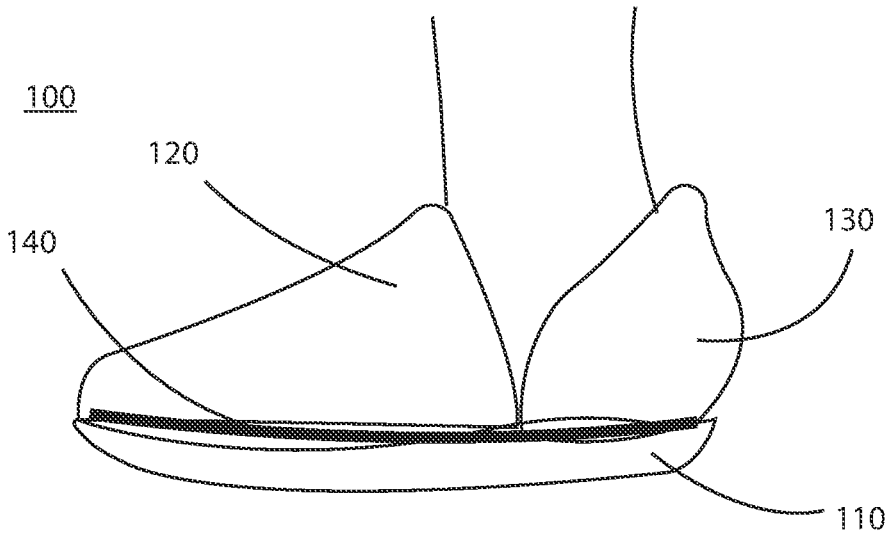

With reference to FIGS. 9A and 9B, in still other embodiments, all or a portion of a footbed 140 of a rapid-entry shoe 100 can be configured to bow upward, independent from or together with an upper, away from a sole portion 110. In such embodiments, an upper heel portion 130 and an upper forward portion 120 can pivot relative to each other, for example, along the upward bow of the footbed 140.

Figure 10A:
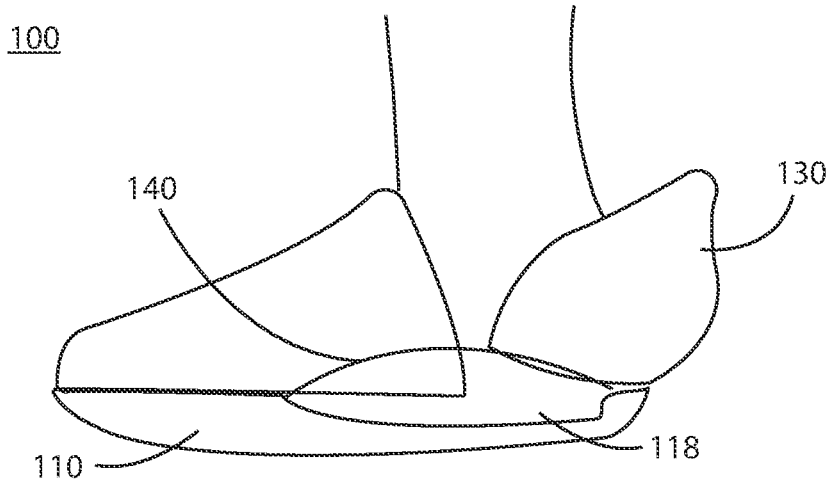
FIGS. 10A and 10B illustrate, in accordance with example embodiments of the present disclosure.
Figure 10B:
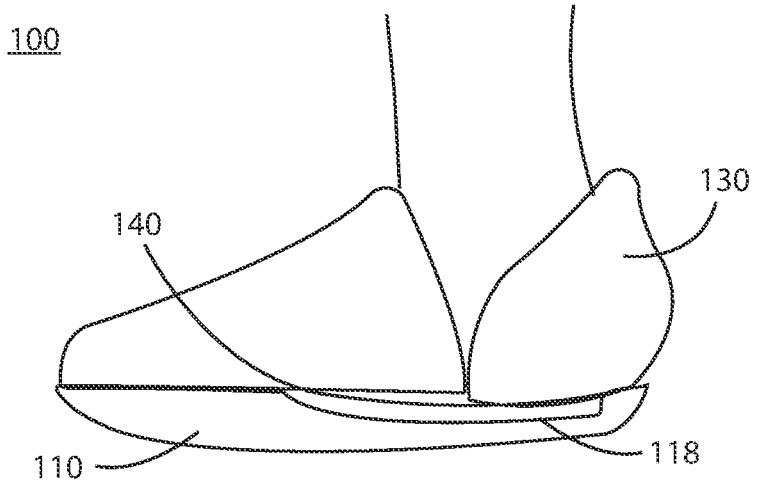

With reference to FIGS. 10A and 10B, in still other embodiments, all or a portion of a footbed 140 of a rapid-entry shoe 100 can be configured to bow upward, independent from or together with an upper, away from a sole portion 110. In such embodiments, an upper heel portion 130 can pivot relative to the sole portion 110 and the footbed 140 can be received in a recess 118 in the sole portion 110.

In accordance with any of the example embodiments described herein, a footbed can be temporarily engaged relative to a sole portion in an open configuration or a closed configuration by a securement element comprising one or more of a hook and loop fastener, magnet, clip, tie, lever, ratchet or the like. In some embodiments, the securement element can be released (i.e., disengaged) by the opposite foot or rapid-entry shoe.

In accordance with any of the example embodiments described herein, a collapsible or stretchable layer can be disposed between a footbed and a sole portion such that it expands in an open configuration and collapses in a closed configuration. In this regard, there can be continuity between the footbed and the sole portion to prevent entry of dirt, debris, liquid, heat, cold or the like.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A rapid-entry shoe comprising:
a sole portion;
a footbed; and
an upper, the upper comprising an upper forward portion and an upper heel portion;
wherein the sole portion is coupled to the upper heel portion;
wherein the footbed is coupled to the upper forward portion;
wherein the footbed is configured to pivot relative to the sole portion between an open configuration, in which a rear edge of the footbed is not in contact with an upper surface of the sole portion, and a closed position, in which the rear edge of the footbed is in contact with the upper surface of the sole portion;
wherein, in the closed configuration, the rear edge of the footbed is positioned underneath at least one bumper coupled to an inner surface of the upper heel portion, the at least one bumper configured to secure the footbed in the closed position; and
wherein the sole portion is configured to remain substantially planar or not bend during transition between the open configuration and the closed configuration.

2. The rapid-entry shoe of claim 1, wherein the at least one bumper is comprised of a foam material.

3. The rapid-entry shoe of claim 1, wherein, in the open configuration, a rear portion of the footbed is angled with respect to a forward portion of the footbed.

4. A rapid-entry shoe comprising:
a sole portion;
a footbed; and
an upper, the upper comprising an upper forward portion and an upper heel portion;
wherein the sole portion is coupled to the upper heel portion;
wherein the footbed is coupled to the upper forward portion to form an upper construction;
wherein the upper construction is configured to pivot relative to the sole portion between an open configuration in which a rear portion of the footbed is angled with respect to a rear portion of the sole portion, and a closed position in which both the rear portion of the footbed is adjacent to the sole portion;
wherein, in the closed position, a rear edge of the footbed is positioned underneath at least one bumper coupled to an inner surface of the upper heel portion, the at least one bumper configured to secure the upper construction in the closed position; and
wherein the sole portion remains substantially planar or does not bend during transition between the open configuration and the closed position.

5. The rapid-entry shoe of claim 4, wherein the at least one bumper is comprised of a foam material.

6. The rapid-entry shoe of claim 4, wherein, in the open configuration, the rear portion of the footbed is angled with respect to a forward portion of the footbed.

7. A rapid-entry shoe comprising:
a sole portion;
a footbed; and
an upper, the upper comprising an upper forward portion and an upper heel portion;
wherein the sole portion is coupled to the upper heel portion;
wherein the footbed is coupled to the upper forward portion;
wherein the footbed is configured to pivot relative to the sole portion between an open configuration, in which at least a portion of the footbed is angled relative to the sole portion and the sole portion retains a substantially flat profile, and a closed position, in which the footbed and the sole portion are substantially parallel to one another.

8. The rapid-entry shoe of claim 7, wherein the upper forward portion comprises a foot hold extending completely under the footbed between opposing sides of the footbed.

9. The rapid-entry shoe of claim 8, wherein the foot hold comprises one or more of a strap and a plurality of laces.

10. The rapid-entry shoe of claim 7, wherein, in the closed position, a rear edge of the footbed is positioned underneath at least one bumper coupled to an inner surface of the upper heel portion, the at least one bumper configured to secure the footbed in the closed position.

11. The rapid-entry shoe of claim 10, wherein the at least one bumper is comprised of a foam material.

12. The rapid-entry shoe of claim 7, wherein, in the open configuration, a rear portion of the footbed is angled with respect to a forward portion of the footbed.

13. The rapid-entry shoe of claim 10, wherein the bumper is spaced vertically above the sole portion.

14. The rapid-entry shoe of claim 10, wherein, when in the closed position, a rear portion of the foot bed is positioned sandwiched between the bumper and the sole portion.

15. The rapid-entry shoe of claim 10, wherein the bumper extends toward a collar of the upper, wherein the bumper flares rearwardly toward the collar of the upper.

16. The rapid-entry shoe of claim 7, further comprising a securement element configured to secure the footbed to the sole portion.

17. The rapid-entry shoe of claim 16, wherein the securement element includes one of a ratchet and a strap.

18. The rapid-entry shoe of claim 17, further comprising a securement release or securement tether.

19. The rapid-entry shoe of claim 18, wherein the securement release or securement tether is configured to interface with the securement element to secure the footbed to the sole portion.

20. The rapid-entry shoe of claim 19, wherein the securement element is positioned on one of the footbed, the sole portion, and the upper.

* * * * *